US008708776B1

(12) United States Patent
Frazer

(10) Patent No.: US 8,708,776 B1
(45) Date of Patent: Apr. 29, 2014

(54) OPTICAL FIBER POLISHING MACHINES, FIXTURES AND METHODS

(75) Inventor: James T. Frazer, Big Lake, MN (US)

(73) Assignee: Domaille Engineering, LLC, Rochester, MN (US)

( * ) Notice: Subject to any disclaimer, the term of this patent is extended or adjusted under 35 U.S.C. 154(b) by 1089 days.

(21) Appl. No.: 12/630,483

(22) Filed: Dec. 3, 2009

Related U.S. Application Data

(60) Provisional application No. 61/119,880, filed on Dec. 4, 2008.

(51) Int. Cl.
*B24B 19/22* (2006.01)

(52) U.S. Cl.
USPC ..... 451/41; 451/390

(58) Field of Classification Search
USPC ..... 451/384, 390, 5, 6, 43, 44, 41
See application file for complete search history.

(56) References Cited

U.S. PATENT DOCUMENTS

| | | | | |
|---|---|---|---|---|
| 4,831,784 | A | 5/1989 | Takahashi | |
| 4,979,334 | A * | 12/1990 | Takahashi | 451/271 |
| 5,185,966 | A * | 2/1993 | Mock et al. | 451/41 |
| 5,216,846 | A | 6/1993 | Takahashi | |
| 5,218,786 | A | 6/1993 | Takahashi | |
| 5,265,381 | A | 11/1993 | Takahashi | |
| 5,351,445 | A | 10/1994 | Takahashi | |
| 5,547,418 | A | 8/1996 | Takahashi | |
| 5,601,474 | A | 2/1997 | Takahashi | |
| 5,640,475 | A | 6/1997 | Takahashi | |
| 5,643,064 | A | 7/1997 | Grinderslev et al. | |
| 6,077,154 | A | 6/2000 | Takashi et al. | |
| 6,165,055 | A | 12/2000 | Takahashi et al. | |
| 6,257,971 | B1 | 7/2001 | Takahashi et al. | |
| 6,547,653 | B2 | 4/2003 | Yamada et al. | |
| D474,212 | S | 5/2003 | Domaille et al. | |
| 6,718,111 | B1 | 4/2004 | Suek et al. | |
| 6,808,314 | B2 | 10/2004 | Yamada et al. | |
| 6,979,255 | B2 | 12/2005 | Yamada et al. | |
| 7,001,080 | B2 | 2/2006 | Minami et al. | |
| 7,103,254 | B2 | 9/2006 | Yamada | |
| 7,118,291 | B2 | 10/2006 | Arai et al. | |
| 7,137,878 | B2 | 11/2006 | Yamada et al. | |

(Continued)

FOREIGN PATENT DOCUMENTS

| | | | |
|---|---|---|---|
| JP | 63300852 | A | 12/1988 |
| JP | 08323606 | A | 12/1996 |
| JP | 2003053652 | A | 2/2003 |

OTHER PUBLICATIONS

English Abstract of Japanese Publication No. 08323606 A, published Dec. 10, 1996, 1 page.

(Continued)

*Primary Examiner* — Robert Rose
(74) *Attorney, Agent, or Firm* — Fredrikson & Byron, P.A.

(57) ABSTRACT

Polishing machines, fixtures and methods for polishing one or more optical fibers upon distinct wear paths are provided. For example, in some embodiments a polishing fixture is provided with a number of ports for fixing optical fibers. The ports may be positioned within the fixture to follow a number of distinct wear paths when the fixture is moved relative to a platen retaining an abrasive film. In some embodiments, the ports may have an angular separation or be positioned at one or more radial distances in order to provide distinct wear paths on the abrasive film.

14 Claims, 15 Drawing Sheets

(56) References Cited

U.S. PATENT DOCUMENTS

| | | | |
|---|---|---|---|
| 7,165,894 | B2 | 1/2007 | Arai et al. |
| 7,169,026 | B2 | 1/2007 | Minami et al. |
| D565,066 | S | 3/2008 | Yamada et al. |
| 7,369,737 | B2 | 5/2008 | Yamada et al. |
| 7,542,648 | B2 | 6/2009 | Yamada et al. |
| 2003/0036342 | A1 | 2/2003 | Yamada et al. |
| 2003/0104775 | A1 | 6/2003 | Yamada et al. |
| 2003/0182015 | A1 | 9/2003 | Domaille et al. |
| 2005/0078928 | A1 | 4/2005 | Yamada |
| 2006/0229006 | A1 | 10/2006 | Yamada et al. |

OTHER PUBLICATIONS

English Abstract of Japanese Publication No. 2003053652 A, published Feb. 26, 2003, 1 page.

English Abstract of Japanese Publication No. 63300852 A, published Dec. 8, 1988, 1 page.

Seikoh Giken, "Polishing Machine," http:l/www.seikoh-giken.co.jp/en/products/grinder.html, 4 pages.

* cited by examiner

OPTICAL FIBER POLISHING MACHINES, FIXTURES AND METHODS

CROSS-REFERENCE TO RELATED APPLICATIONS

This application claims priority from U.S. Provisional Application Ser. No. 61/119,880, filed Dec. 4, 2008 and titled "Optical Polishing Fixture and Methods," the contents of which are hereby incorporated by reference in their entirety.

FIELD

The disclosure generally relates to optical fiber polishing machines, and more specifically relates to fixtures for securing one or more optical fibers and methods of polishing optical fibers.

BACKGROUND

A typical fiber-optic cable generally includes concentric layers of protective or supporting material with an optical fiber located at the center of the cable. These fiber-optic cables typically have connectors located on each end to connect them to another fiber-optic cable or to a peripheral device. These connectors are high precision devices which position the fiber-optic cable in line with another fiber-optic cable or to a port on a peripheral device.

In order to communicate with a port or another cable, the end face of the connector (including a ferrule and an optical fiber) must typically abut an adjacent cable or port. The finish of the end face of a fiber will typically determine the amount of back reflection at the connection site, thus greatly affecting the ability of the fiber-optic cable to transmit information. The apex offset, protrusion/recession, insertion loss, return loss, and angularity are also integral parameters of a fiber's finish. As such, the end face of a fiber is usually polished to exacting standards so as to produce a finish with minimal back reflection. For example, it is often necessary to polish the end face of the fiber to a precise length, i.e., so the end face projects a predetermined amount from a reference point such as a shoulder on the fiber optic connector within a predetermined tolerance. Fiber-optic cables having multiple optical fibers can also be polished to produce a particular finish.

Optical fiber polishing machines (sometimes referred to herein as "polishers") typically include a rotating platen and a fixing or mounting mechanism, such as an arm or corner mounts, which positions and supports the optical fibers during the polishing process. Typically, the end face of an optical fiber is lowered onto an abrasive film resting on the platen, and depending upon the film, the speed of the platen, the pressure applied, and its duration, acquires a finish suitable for a particular application.

Optical fiber polishing machines generally include a fixture, coupled to the mounting mechanism, that is capable of holding and gripping one or more optical fibers (e.g., by holding a fiber ferrule or connector) and advancing them under controlled conditions of speed and force to engage a plurality of fiber optic ends into engagement with a polishing member such as a rotatable platen with an abrasive surface or film.

SUMMARY

According to an aspect of the invention, an optical fiber polishing fixture is provided for use with an optical fiber polishing machine. The fixture includes a base having a bottom surface and multiple ports positioned about a center of the base and extending through the bottom surface of the base. Each port is configured to align an optical fiber above a platen of the optical fiber polishing machine for polishing an end of the optical fiber as the platen and the fixture undergo a relative motion. An angular separation between at least a first port and a second port with respect to the center of the fixture base is based on the relative motion of the platen and the fixture such that the first port and the second port follow distinct wear paths upon an abrasive surface on the platen as the platen and the fixture undergo the relative motion.

According to another aspect of the invention, another optical fiber polishing fixture is provided for use with an optical fiber polishing machine. The fixture has a base with a bottom surface and a number of ports positioned about a center of the base and extending through the bottom surface of the base. Each port is configured to align an optical fiber above a platen of the optical fiber polishing machine for polishing an end of the optical fiber as the platen and the fixture undergo a relative motion. A first group of the ports are substantially positioned along a first circular path about the center of the base. At least two ports in the first group are positioned from the center of the base at respective radial distances varying by a least about a width of an optical fiber, but by no more than about the width of the optical fiber times the quantity of ports in the first group. The varying radial distances of the first port and the second port produce distinct wear paths upon an abrasive surface on the platen for the first port and the second port as the platen and the fixture undergo the relative motion.

According to further aspects of the invention, systems for polishing optical fibers are provided. The systems include one or more of the above-described polishing fixtures and an optical fiber polishing machine having a platen configured to retain an abrasive film, a mounting mechanism coupled to the fixture, and a drive mechanism, the drive mechanism causing the fixture and the platen to undergo the relative motion.

According to another aspect of the invention, a method for polishing optical fibers is provided. The method includes providing an optical fiber polishing machine having a platen and positioning an abrasive film on the platen of the polishing machine. The method further includes coupling an optical fiber polishing fixture above the platen and the abrasive film, positioning a plurality of optical fibers in the fixture, and causing a relative motion between the fixture and the platen. At least first and second optical fibers are positioned about a center of the fixture with an angular separation with respect to the center of the fixture based on the relative motion of the platen and the fixture such that the first optical fiber and the second optical fiber follow distinct wear paths upon the abrasive film as the platen and the fixture undergo the relative motion.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION OF THE PREFERRED EMBODIMENTS

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

The embodiments herein disclose an optical polishing machine (also referred to as a "polisher") which is particularly adapted to provide precise and relatively uniform polishing of a number of optical fibers. For the purposes of explanation only, the disclosed embodiments are described in terms of an apparatus which is particularly configured for optical fiber polishing. However, one skilled in the art can readily appreciate that the embodiments of the invention can be adapted for a variety of different polishing applications.

Figure 1:
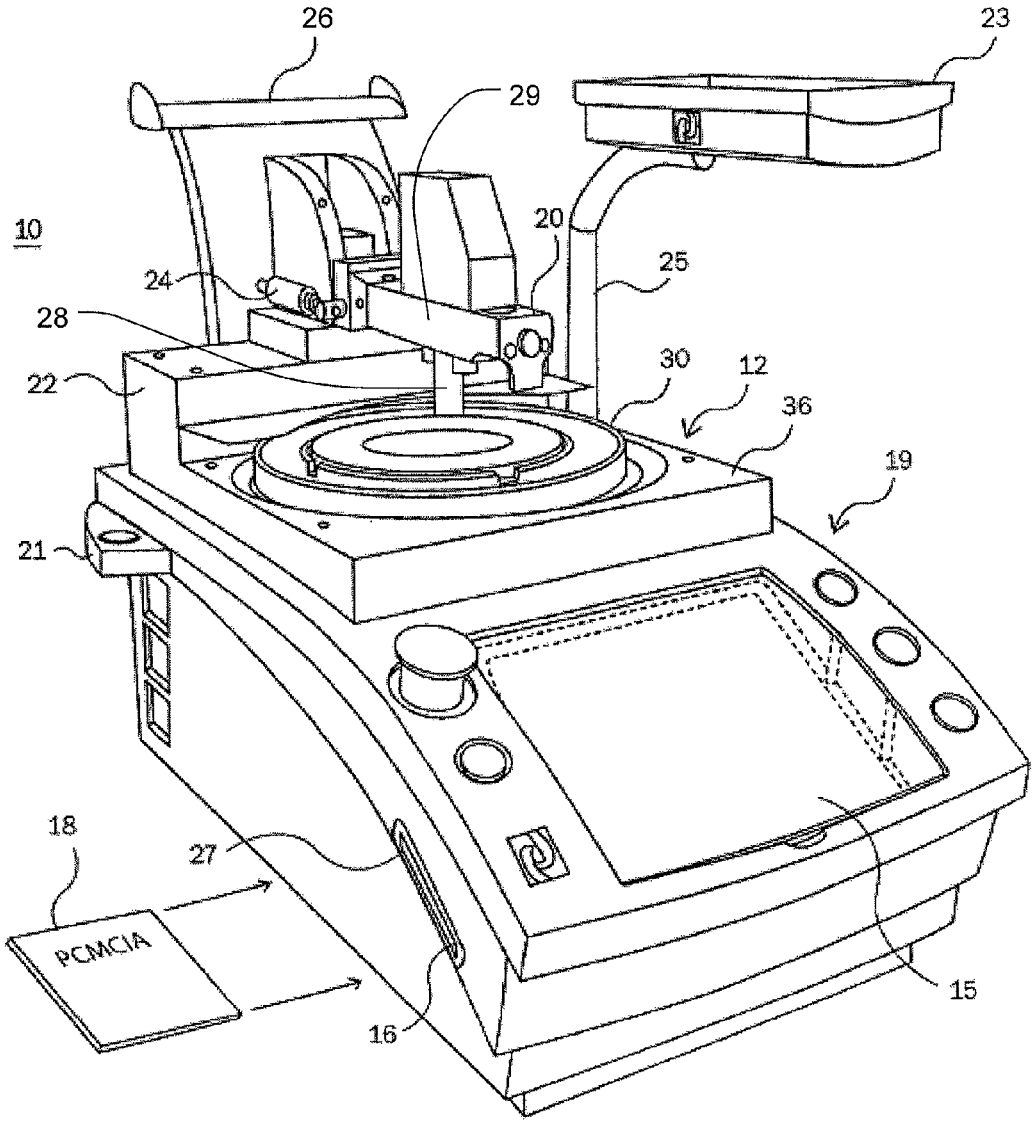
FIG. 1 is a polishing machine according to some embodiments of the invention.

FIG. 1 is a perspective view of a polishing machine 10 useful for polishing optical fibers according to some embodiments of the invention. The polishing machine 10 includes a polishing unit 12 comprising a pneumatic overarm assembly 20 and a platen assembly 30, a processor, a porting device 16 for a portable memory device 18, and an input device 15.

The polishing machine 10 maintains rigid control of each polishing process through feedback mechanisms which control the operation of both the platen assembly 30 and the pneumatic overarm assembly 20. The feedback mechanisms communicate with the processor to continuously monitor the performance of the platen assembly 30 and the pneumatic overarm assembly 20, and ensure that both are functioning at their set levels.

In some embodiments, the processor communicates with the porting device 16, the input device 15 and a USB port for a keyboard, to enable rapid programming of the polishing machine 10. The input device 15 also serves as a visual indicator of actual operating parameters.

As shown in FIG. 1, in some embodiments, the polishing machine 10 includes a housing 19 which is particularly adapted for the polishing process. The housing's main function is to support and align the polishing unit 12, the processor, and the input device 15 in an operative position.

The housing 19 also includes a retractable ring 21 for use as a point of attachment for ancillary devices. One such ancillary device is a drip pan 23 rotatably coupled to the retractable ring 21 by an elongated stem 25. A slot 27 is inserted along one side of the housing 19 to allow a portable memory device to access the porting device 16. A retractable shield is located along a front portion of the housing 19 to protect the input device 15, which is angularly supported in the front of the housing 19. A cable management attachment 26 is connected to the back of the housing for supporting fiber-optic cables undergoing a polishing process.

The pneumatic arm assembly 20 includes an overarm hingedly secured along one end to a base 22, the overarm 29 rotatable about the hinged end. A pair of pneumatic cylinders 24 are coupled to the overarm 29, opposing rotational movement thereof. A mounting pole 28 depends from the overarm 29.

Figure 2:
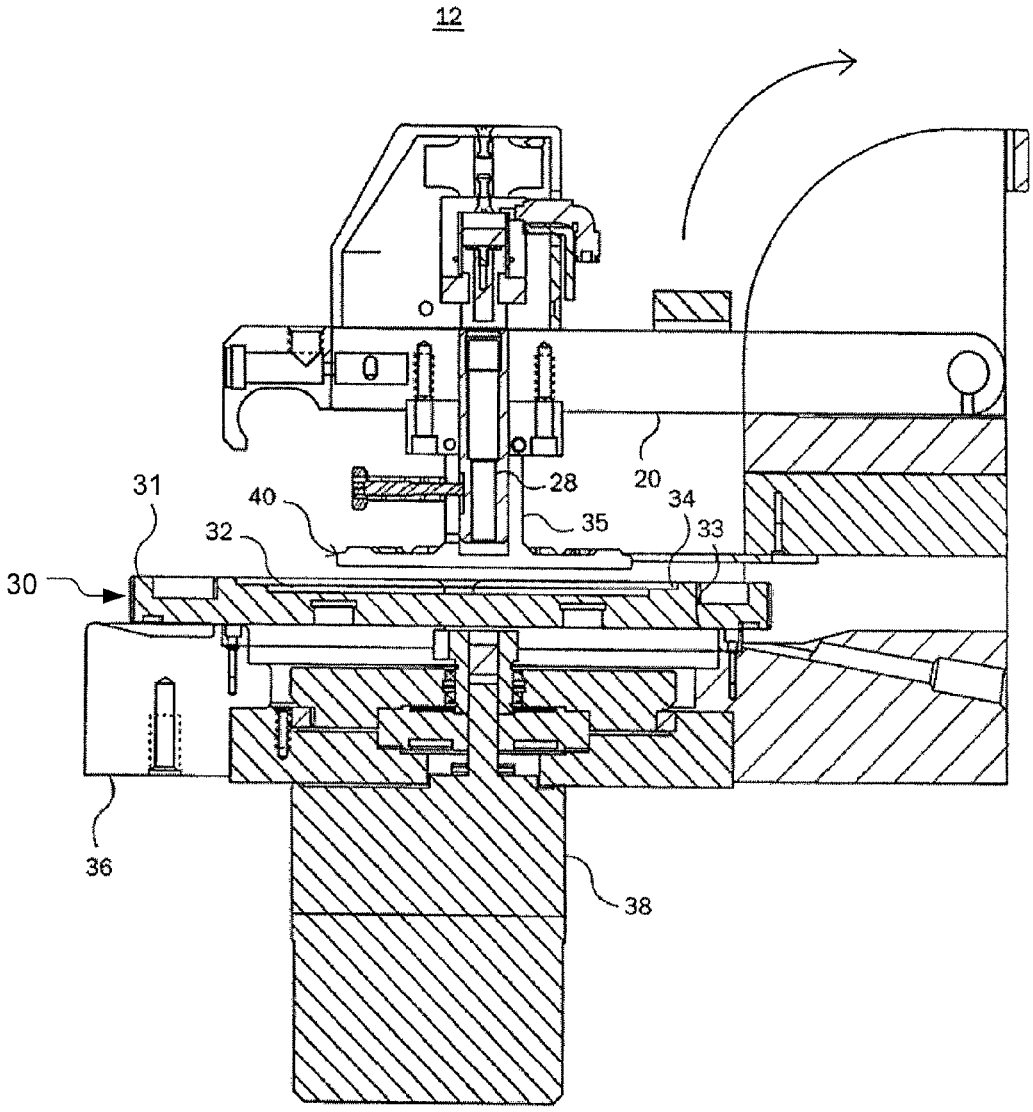
FIG. 2 is a cross-section of a portion of the polishing machine of FIG. 1.

Referring to FIG. 2, a cross-section of a portion of the polisher of FIG. 1 is shown. A polishing fixture 40, including a mounting tube 35, releasably engages the mounting pole 28. The polishing fixture 40 includes a number of ports (not shown) for fixing optical fibers within the fixture. For example, the fixture 40 may include ports configured to hold optical fiber connectors and/or optical fiber ferrules. In one embodiment, a load cell and air cylinder are coupled to the overarm 29 to control movement of the polishing fixture. The load cell and air cylinder may, for example, cooperate with a plunger extending through the mounting pole 28 to adjust the polishing fixture. During operation, the plunger translates pressure applied to the fixture by moving longitudinally with respect to the mounting pole 28.

Referring to FIGS. 1 and 2, the platen assembly 30 includes a platen 31 configured to retain an abrasive film or pad for polishing optical fibers held by the fixture 40. In one embodiment, the platen 31 is generally circular and has a top surface 32 and a bottom surface 33. The top surface 32 includes retaining structures 34 for receiving an abrasive film. The bottom surface 33 includes a means for coupling the platen 31 with a motor 38.

Figure 3:
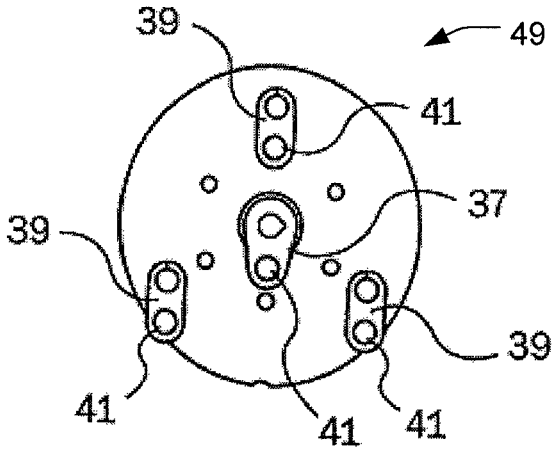
FIG. 3 is a bottom view of a drive plate for moving a platen according to some embodiments of the invention.

In some embodiments of the invention, the platen 31 is moved in an eccentric fashion with respect to the polishing fixture 40. For example, in some cases the platen 31 rotates about the axis of the platen, while the platen axis revolves along a path about the center of the polishing fixture 40. Referring to FIG. 3, to impart such rotational motion and revolving motion, in one embodiment the platen 31 is rotatably supported by a stage 36 and coupled to the motor 38 with a drive plate 49 and an eccentric drive arm 37. A plurality of eccentric free arms 39 are rotatably supported on one end by the drive plate 49 and engage the platen 31 along the other end. The eccentric free arms 39 guide and support the radial movement of the platen 31. The drive arm 37 and the free arms 39 each have a free end with a locking pin 41 which extends perpendicularly therefrom to engage the bottom surface 33 of the platen 31. A plurality of bearings (not shown) disposed between the top and bottom surfaces (FIG. 2) cooperate with the drive arm 37 and free arms 39 to facilitate movement of the platen 31.

Thus, optical fibers fixed within the polishing fixture 40 are polished or ground against an abrasive film on the platen 31 as the platen 31 and polishing fixture 40 move relative to each other, e.g., undergo a relative motion. FIGS. 2 and 3 illustrate an embodiment where the platen 31 moves and the polishing fixture 40 remains stationary. In some embodiments the relative motion may actually be accomplished by moving the polishing fixture in a similar eccentric manner with respect to the platen 31 and abrasive film (which remains stationary), or by moving both the fixture and the platen.

Figure 4:
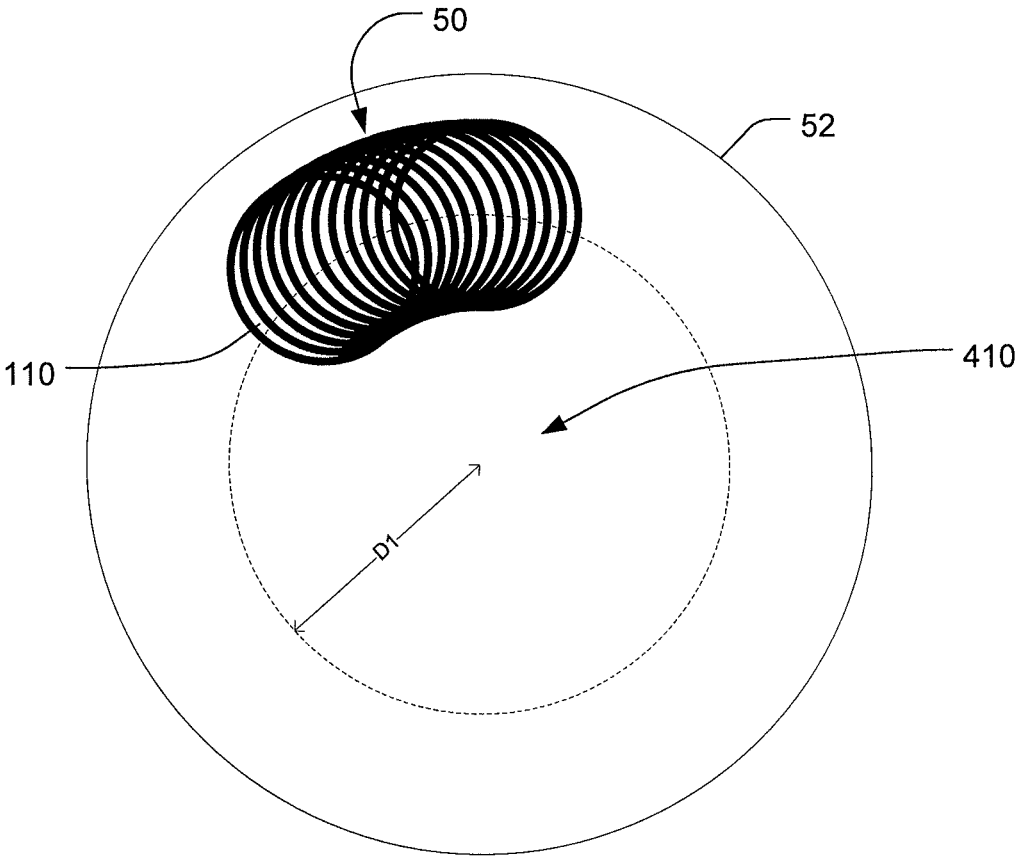
FIG. 4 (Prior Art)
FIG. 4 is a top view of a conventional abrasive film having one or more wear patterns.

Some conventional polishing machines may also use an eccentric motion to polish optical fibers. FIG. 4 illustrates a wear path 50 upon an abrasive film 52 created by some conventional optical polishing machines. The circular wear path 50 is formed as the platen (and film 52) rotates about the platen axis and revolves with respect to the polishing fixture. As the platen rotates and revolves, the optical fibers held in the fixture follow the wear path 50 upon the abrasive film. The wear path 50 is located on the abrasive film 52 at a distance $D_1$ from the center of the abrasive film 52, which corresponds to the physical layout of the optical fibers within the polishing fixture.

Figure 5A:
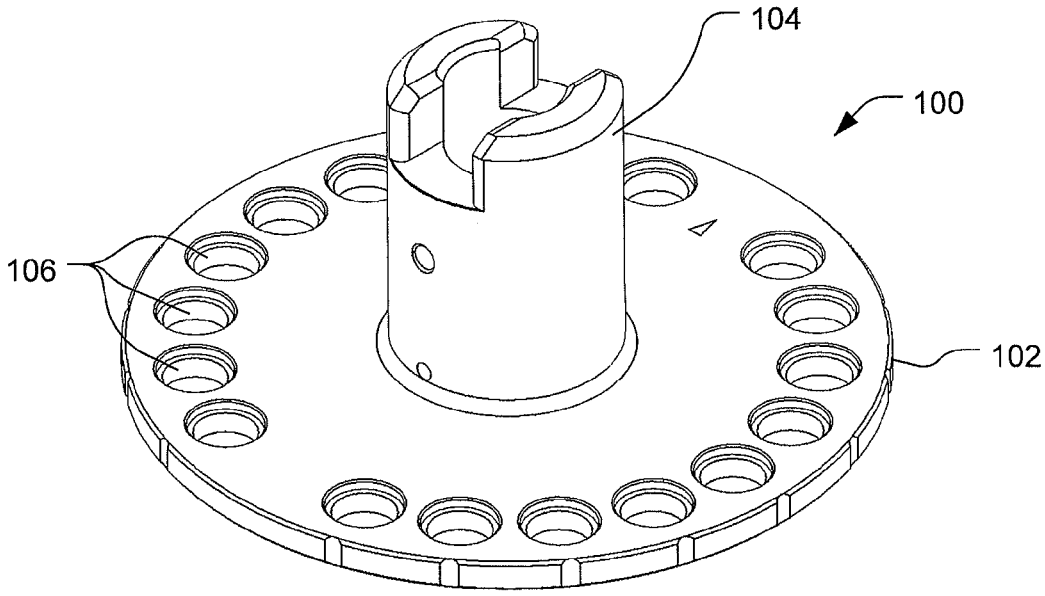
FIG. 5A is a perspective view of a polishing fixture according to some embodiments of the invention.
Figure 5B:
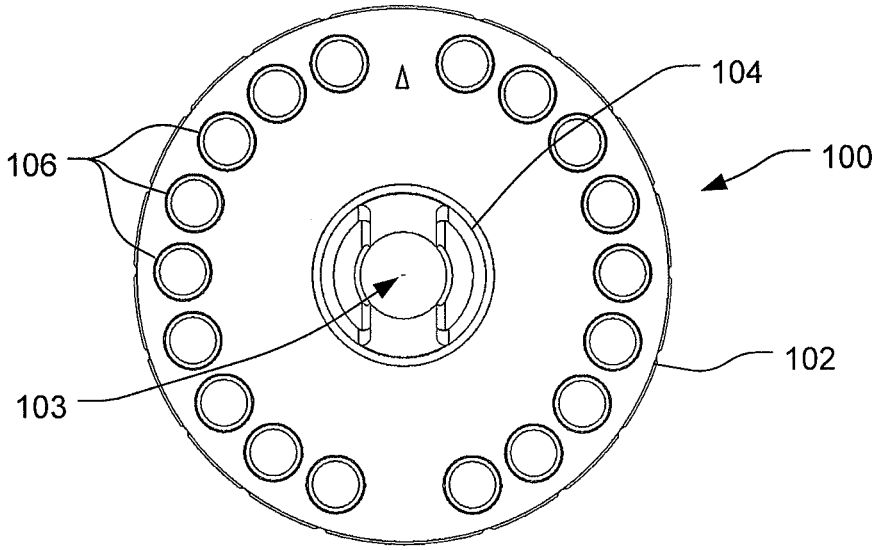
FIG. 5B is a top view of the polishing fixture of FIG. 5A.
Figure 5C:
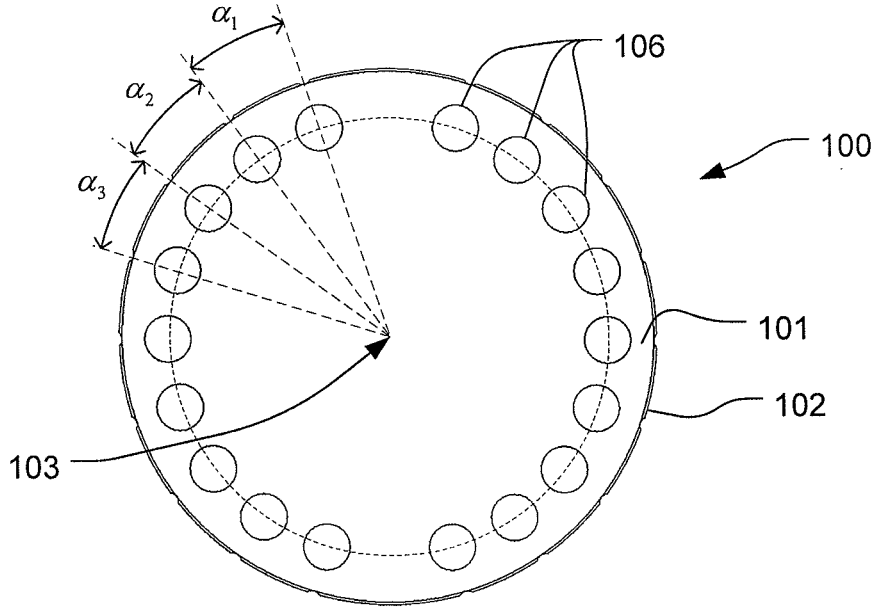
FIG. 5C is a bottom view of the polishing fixture of FIG. 5A.

FIGS. 5A-5C illustrate various views of an optical fiber polishing fixture 100 according to some embodiments of the invention. The fixture 100 includes a fixture base 102 having a bottom surface 101 and a mounting tube 104 extending generally perpendicularly from the fixture base 102, for coupling the fixture 100 with the polishing machine 10 via a mounting pole, such as mounting pole 28 in FIG. 2. The fixture base 102 includes a number of ports 106 that are positioned about a center of the base 102 and that extend through the bottom surface 101 of the base 102. In some embodiments the ports 106 are positioned circumferentially around the fixture base, e.g., substantially positioned along a circular path about the center 103 of the base 102 or in one or more substantially circular rows about the center 103 of the base 102.

The ports 106 are each configured to receive at least one optical fiber and hold and align the optical fiber(s) above the platen 31 for polishing. For example, as shown in FIGS. 7A-7B, 9A-9B, and 10A-10B, in some embodiments a fixture also includes a clamping assembly, an insert, or other such holding mechanism positioned in each port for receiving and securing one or more optical fibers. The clamping assemblies, inserts, or other holding mechanisms may be configured to receive and secure an optical fiber connector and/or an optical fiber ferrule. FIGS. 5A-5C for example, include ports 106 configured for FC-type connectors. The ports 106 and/or holding mechanisms within the ports may be configured to receive any desired optical fiber connector and/or ferrule, and the invention is not limited to any particular configuration.

Referring to FIGS. 5A-5C, as the platen and fixture base move relative to each other, each port 106, and the corresponding fiber(s) within the port, follow a wear path on the abrasive film located on the platen. In some embodiments of the invention, the ports 106 are located within the fixture base 102 so as to advantageously follow two or more different wear paths upon an abrasive film rotated by a platen. For example, in some embodiments, the ports 106 are positioned or spaced about the center of fixture base 102 to create multiple wear paths. In some cases, one or more ports 106 may follow distinct (e.g., different, unique) wear paths on the abrasive film as the platen and the fixture undergo relative motion. In at least one embodiment, the ports 106 are configured so that each port 106 follows a distinct wear path on the abrasive film as the platen and the fixture move relative to each other.

Referring to FIG. 5C, in some embodiments of the invention, the ports 106 are positioned about the center 103 of the fixture base 102 with one or more angular separations a with respect to the center 103 of the base 102. For example, the ports 106 may be circumferentially-spaced about the center of the fixture base 102 with a predetermined angular spacing.

In some embodiments the angular spacing between two or more ports 106 is based on the relative movement of the platen and the base in order to produce distinct wear paths upon an abrasive film residing on the platen. As previously described, in some embodiments the platen revolves about the fixture base as it rotates about the platen axis. In some embodiments the angular separation is based on the revolving movement of the platen. For example, in some cases a platen is moved relative to the polishing fixture 100 with a 120:1 eccentric drive. For each rotation of the platen, the platen is revolved an incremental amount of 360/120=3 degrees about the center 103 of the polishing fixture. In some embodiments, the angular separation between at least two of the ports 106 is based on the incremental amount of revolution. As just one example, the angular separation may be different than the incremental amount of revolution of 3 degrees or a multiple thereof.

Defining the angular separation of the ports 106 differently from a multiple of the amount of platen revolution per rotation can advantageously provide distinct wear paths upon an abrasive film for one or more ports/fibers. In some cases, this type of spacing can make use of a greater surface area of an abrasive film than if two or more ports follow the same wear path. For example, referring to FIG. 4, in past polishing applications, ports following the same wear path 50 left unused portions 110 of the abrasive film between successive rotations in the wear path as the platen and film rotated and revolved with respect to the polishing fixture. Angularly spacing the ports 106 differently than the incremental amount of revolution allows some or all of the ports 106 to follow distinct wear paths upon the abrasive film. This advantageously uses more of the abrasive film, including in some instances, the portions 110 left unused in conventional polishing machines.

Providing one or more distinct wear paths provides a number of advantages in polishing optical fibers. For example, distinct wear paths can lead to a greater use of the surface of the abrasive film. In another example, films can be used for a longer period of time, which can reduce the number and cost for replacement films. In some cases embodiments of the invention may provide a higher quality polish and/or a reduced polishing cycle time due to the increased abrasive use.

In some embodiments, the angular separation between two or more ports 106 is a function of the motion of the platen and also the number of ports on the fixture. For example, the angular spacing can be determined in part by dividing the incremental amount of revolution of the platen by the number of ports substantially positioned along a circular path about the center of the fixture. In some embodiments, the angular separation is a sum of a multiple of the incremental amount of revolution and an adjustment amount equal to the incremental amount of revolution divided by the number of ports along the circular path on the fixture. With reference to FIG. 5C, a fixture with 18 ports being revolved in 3° increments has, in some cases, an angular separation between ports that is adjusted 0.167° (3° divided by 18 ports) from 18° (a multiple of the 3° incremental amount of revolution). Thus, in some embodiments each port 106 is separated by angles $\alpha_1$, $\alpha_2$, $\alpha_3$, etc., of approximately 18.167°.

Many angular separations are possible, depending upon such things as the number and size of the ports and the mechanics of the platen movement (e.g., rotation and/or revolution). The invention is not limited to any particular configuration. In some embodiments, the angular separation between all pairs of adjacent ports may not be the same. For example, two or more of angles $\alpha_1$, $\alpha_2$, $\alpha_3$, etc., in FIG. 5C may have different values. In another embodiment, all the ports may be separated by different angles. Accordingly, the angular separation between any two adjacent ports 106 may or may not be the same as the angular separation between two other adjacent ports 106 on a particular polishing fixture.

Figure 6A:
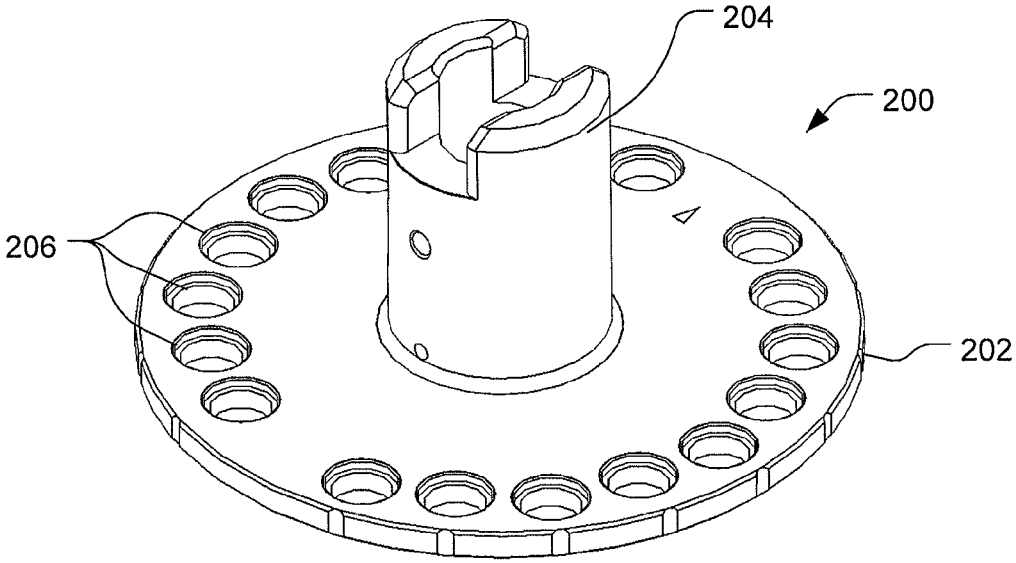
FIG. 6A is a perspective view of a polishing fixture according to some embodiments of the invention.
Figure 6B:
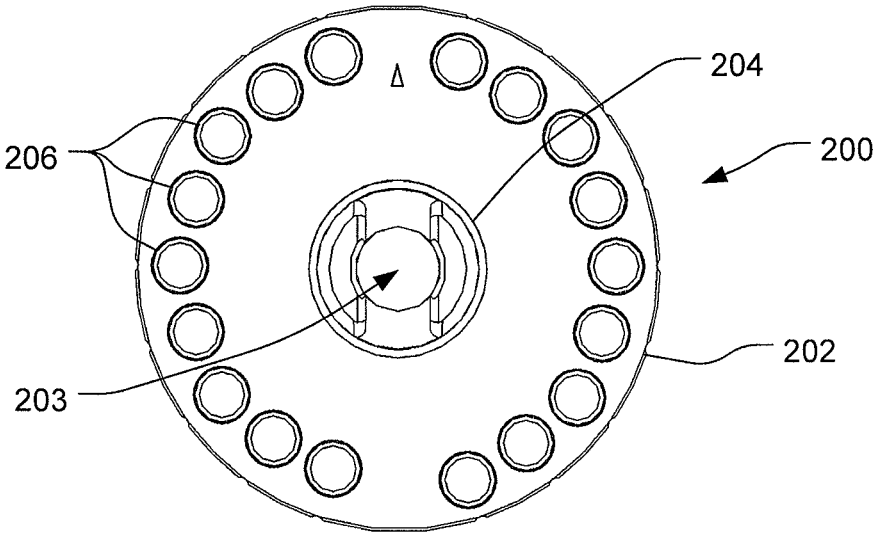
FIG. 6B is a top view of the polishing fixture of FIG. 6A.
Figure 6C:
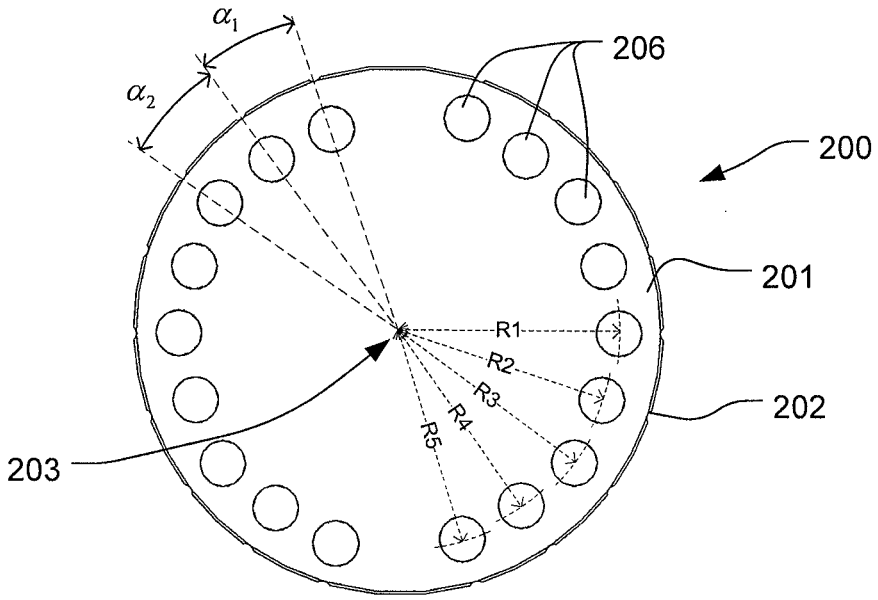
FIG. 6C is a bottom view of the polishing fixture of FIG. 6A.

Referring to FIGS. 6A-6C, in some embodiments multiple wear paths are created by positioning the ports 206 at different radial distances from the center 203 of the polishing fixture base 202. With reference to FIG. 6C, for example, adjacent ports 206 may have different radial distances $R_1$, $R_2$, $R_3$, $R_4$, $R_5$, and so on, which cooperate with an eccentric drive to create multiple wear paths. Locating the ports 206 at more than one radial distance causes two or more ports to follow different wear paths, thus leading to a greater utilization of the abrasive film, longer film wear, shorter polishing time, higher quality polishing, and a number of other advantages.

A wide variety of radial configurations may be used for port locations. For example, each port 206 on the polishing fixture 200 may have a different radial distance from the center 203 of the fixture base 202. In some embodiments, a portion of the ports may be located at substantially the same radial distance while other ports are spaced further or nearer the center of the fixture base. A wide variety of radial distances are possible, depending on such variables as the number and size of the ports on the fixture and the movement of the platen and/or fixture.

Referring to FIG. 6C, in some embodiments the ports 206 in a fixture 200 are substantially positioned along a circular path about the center of the base. In some embodiments, the radial distance of one or more ports is adjusted, e.g., increased or decreased, by approximately a multiple of the width, w, of an optical fiber being polished. As used herein, the width of an "optical fiber" may refer to the width of the optical fiber core, the cladding, the jacket, or the ferrule depending upon a particular configuration. In some cases the width of an optical fiber may also refer to the width of the optical fiber's connector. Referring to FIG. 6C, in some embodiments $R_2$ is approximately $R_1-w$, $R_3$ is approximately $R_1+w$, $R_4$ is approximately $R_1-2w$, $R_5$ is approximately $R_1+2w$, and so on.

In some embodiments some or all of the ports 206 are positioned from the center of the base at respective radial distances varying by a least about the width, w, but by no more than about the width, w, times the number of ports positioned on the circular path. When w is relatively small compared to the overall radial distance from the center of the fixture base, this configuration allows a number of ports to be substantially positioned along a circular path while also providing slightly different radial distances to create multiple distinct wear paths on the abrasive film. In some cases w may be about 0.005 inches, although w may change depending upon the size of fiber being polished or as otherwise desired. In some embodiments, the ports 206 may be spaced apart by an amount substantially larger than the width of an optical fiber.

Referring still to FIG. 6C, in some embodiments the polishing fixture 200 may provide multiple, distinct wear paths by positioning ports both at multiple radial distances R and at one or more angular separations as described with respect to FIG. 5C. Alternately, in some embodiments, distinct wear paths may be provided by only altering the radial distance R of the ports 206. In still further embodiments, distinct wear paths may be provided by only varying the angular spacing, while locating the ports at substantially the same radial distance from the center of the fixture base.

Figure 7A:
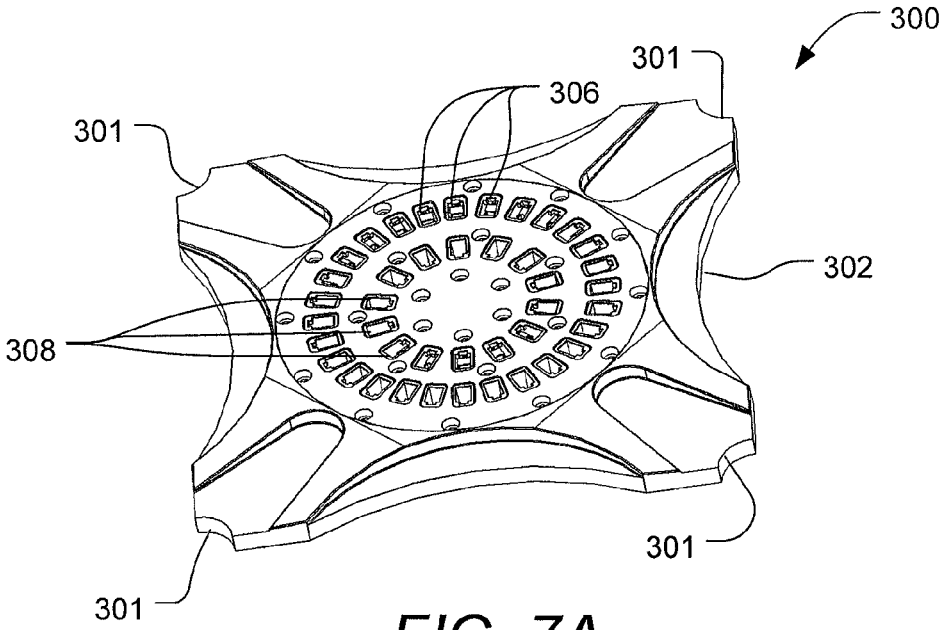
FIG. 7A is a perspective view of a corner-mounted polishing fixture according to some embodiments of the invention.
Figure 7B:
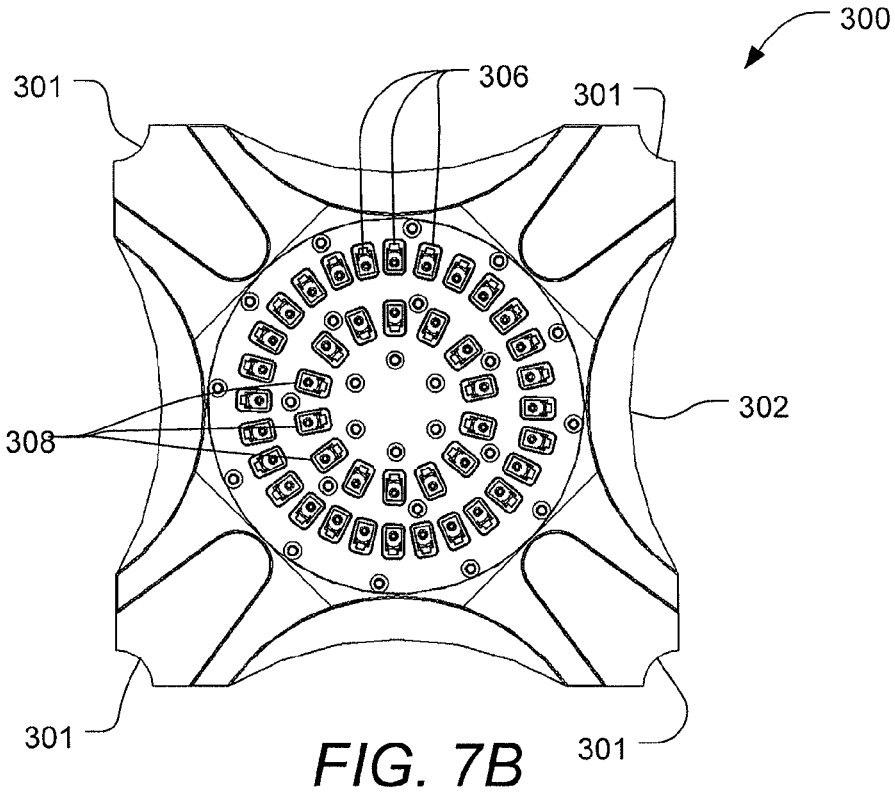
FIG. 7B is a top view of the polishing fixture of FIG. 7A.
Figure 7C:
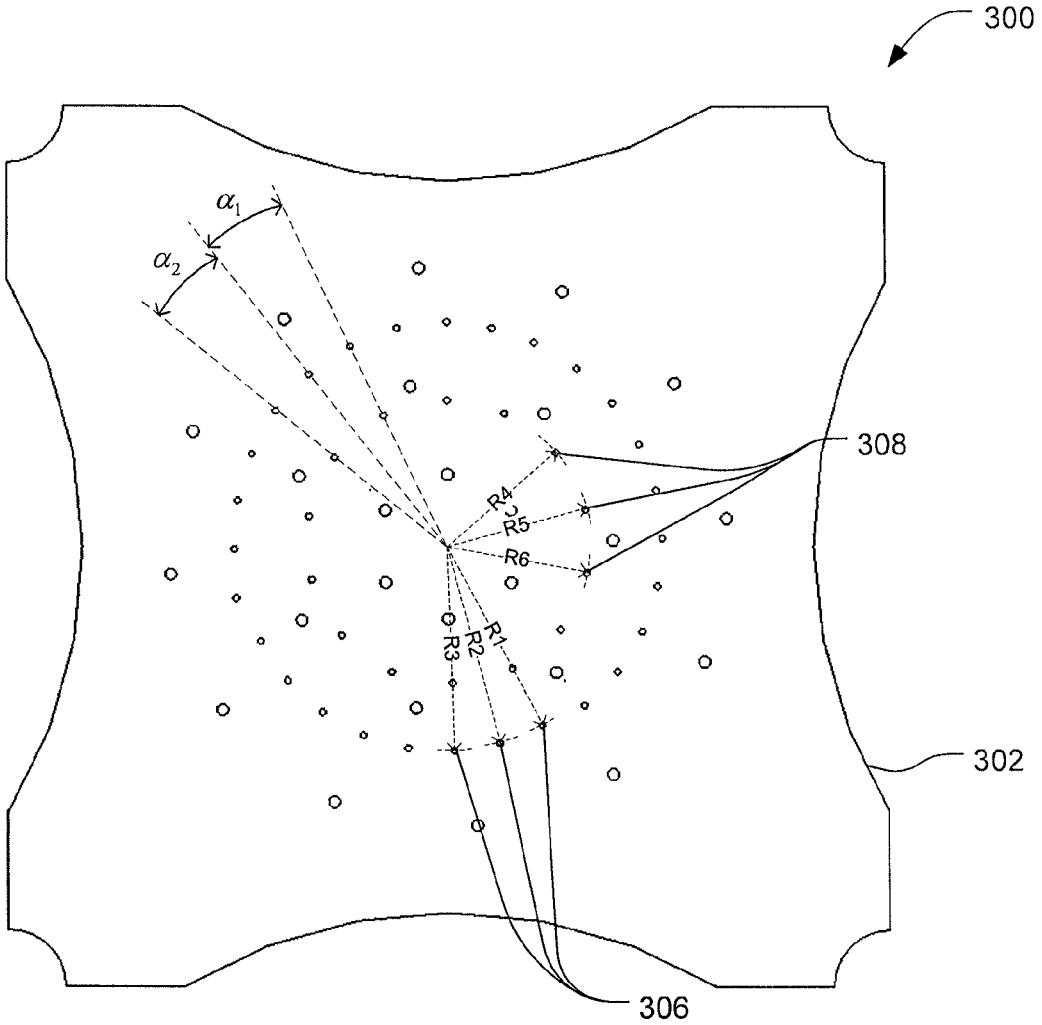
FIG. 7C is a bottom view of the polishing fixture of FIG. 7A.

While circular, center-mounted polishing fixtures have been shown thus far, the invention is not limited to any particular shape or configuration for a polishing fixture. For example, the polishing fixture may have any one of a circular, octagonal, or any other polygonal shaped base. In addition, the fixture may be configured to be mounted along one or more edges or corners of its base. With reference to FIGS. 7A-7C, in some embodiments a polishing fixture 300 is provided with a base 302 configured to be mounted above a platen at its four corners 301. In this embodiment, the base 302 has a somewhat rectangular or square-like shape, although other geometries are possible. The base 302 includes an outer ring of ports 306 and an inner ring of ports 308. As shown in FIGS. 7A and 7B, an insert is positioned within each port 306, 308 for coupling with an optical fiber connector. Each ring of ports 306, 308 may be located upon the fixture base 302 in substantially the same manner as with any other embodiment. For example, the radial spacing $R_1$, $R_2$, $R_3$, $R_4$, $R_5$, and so on, or the angular separation $\alpha_1$, $\alpha_2$, etc., of the ports may be adjusted to provide, based on the relative motion of the platen and fixture, multiple distinct wear paths upon an abrasive film.

Figure 8:
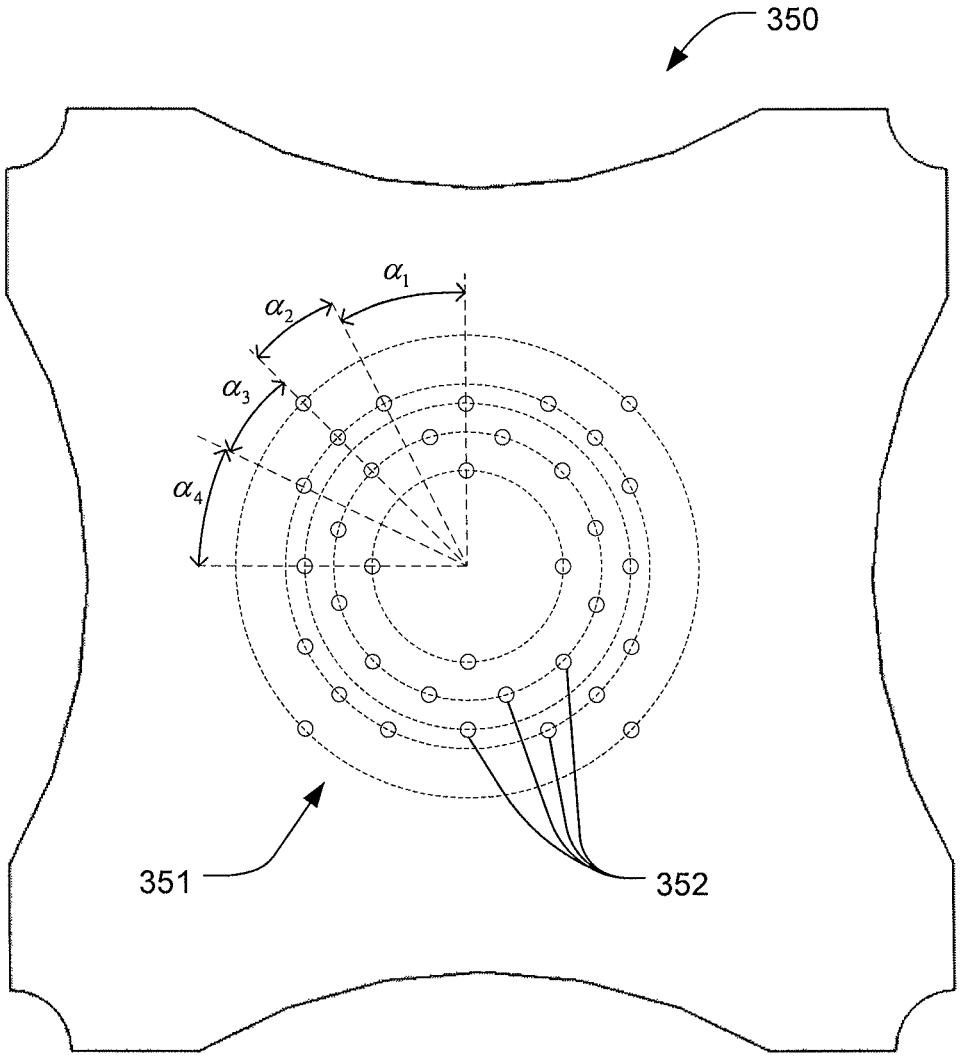
FIG. 8 is a top view of a corner-mounted polishing fixture according to some embodiments of the invention.

Referring now to FIG. 8, some embodiments of the invention include a polishing fixture 350 providing a rectangular configuration 351 of ports 352. The ports 352 may generally be aligned in one or more rectilinear rows and/or columns. The rectangular configuration 351 may provide multiple distinct wear paths upon an abrasive film through techniques such as those described earlier. For example, while being arranged in rows and columns, the ports 352 may also be arranged in concentric circles such that ports 352 having roughly about the same radius with respect to a center of the fixture 350 are separated by an angular spacing similar to previously described embodiments. With respect to the embodiment in FIG. 8, the angular spacing $\alpha_1$, $\alpha_2$, $\alpha_3$, $\alpha_4$, etc. may provide a distinct wear path for each port 352. In addition, some or all ports 352 may be positioned at different radial distances with respect to the center of the polishing fixture. Thus, multiple wear paths are provided. In some cases, each port 352 may have a distinct, unique wear path.

Figure 9A:
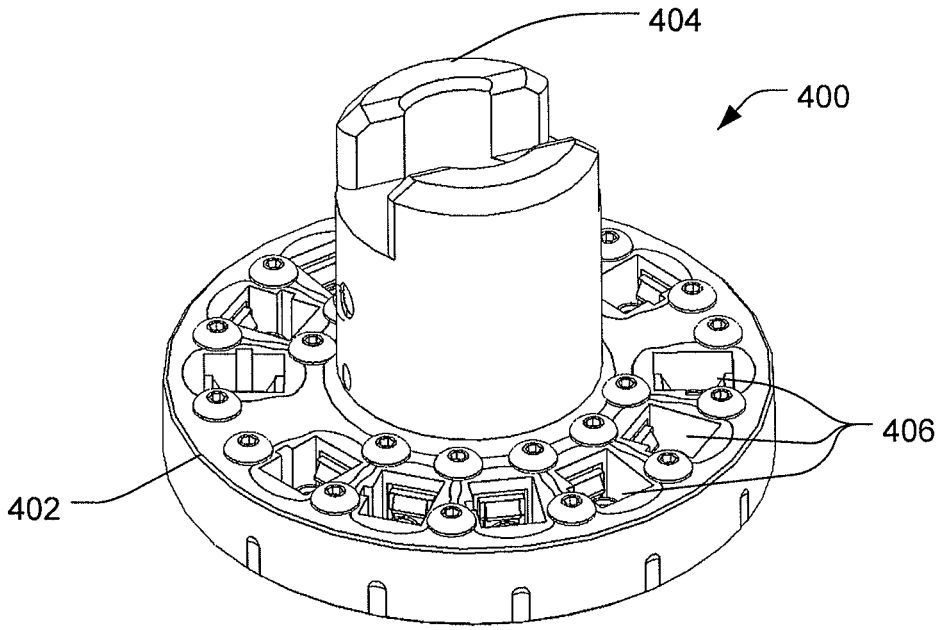
FIG. 9A is a perspective view of a polishing fixture according to some embodiments of the invention.
Figure 9B:
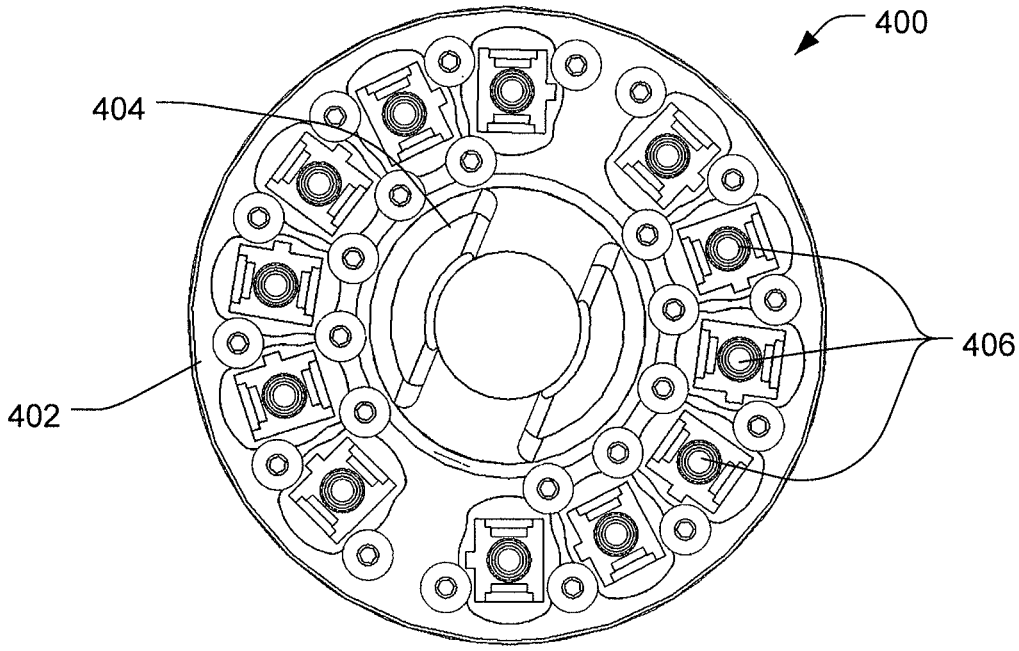
FIG. 9B is a top view of the polishing fixture of FIG. 9A.
Figure 9C:
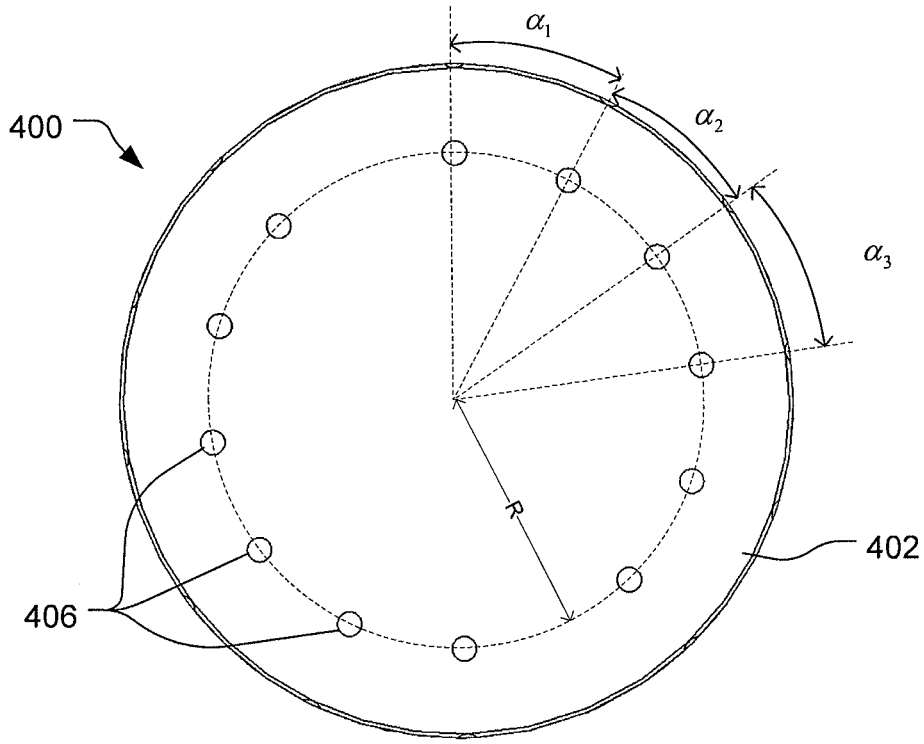
FIG. 9C is a bottom view of the polishing fixture of FIG. 9A.

Referring now to FIGS. 9A-9C, in some embodiments a polishing fixture 400 is provided with a disproportionate size, e.g., radius, with respect to an abrasive film. For example, optical-grade abrasive films are often manufactured in standard sizes, e.g., with a 5-inch diameter, to fit various polishing machines. In many cases, abrasive films are used and then discarded with a substantial portion of the film remaining unused due to the physical configuration of the polishing fixture and the mechanical movement of platen. For example, with respect to FIG. 4, optical fiber connectors may be mounted about the periphery of a polishing fixture such that the wear path 50 forms on the abrasive film 52 while leaving an interior portion 410 of the film 52 unused.

By providing differently sized polishing fixtures, larger areas of the abrasive film can be used, including greater amounts of the interior portion 410, thus reducing the overall number of films needed and the associated cost. Referring again to FIGS. 9A-9C, in one embodiment the polishing fixture 400 may include a number of ports 406 (and associated connector inserts) approximately positioned at a substantially smaller average radius than the radius of an associated abrasive film. For example, the ports 406 may be positioned at an average radius, R, of about 1.0 inch, from the center of the fixture base 402.

Thus, the polishing fixture 400 can be used to polish optical fiber ends using a greater portion of the center of an abrasive film. For example, a polishing fixture with ports fixed at a larger average radius (e.g., about 1.5 inches) may be employed with a 5-inch diameter abrasive film, creating wear paths about the outer portion of the film. Another fixture with ports at a smaller radius can be used to polish fibers using a more central area of the abrasive film.

The ports for the polishing fixture 400 may also have a variety of angular separations and radial distances, as described with respect to previous embodiments. For example, each port 406 may be located at a unique radial distance from the center of the fixture base 402. In another embodiment, adjacent ports 406 may have an angular separation $\alpha_1$, $\alpha_2$, etc., based on the relative motion of the platen and fixture to produce distinct wear paths on the abrasive film for one or more ports. For example, for a polishing machine with a 120:1 eccentric drive, the twelve ports 406 of fixture 400 may be spaced approximately 25° apart. In another embodiment, the angular separation between adjacent ports 406 may be offset from a multiple of the incremental amount of revolution 3° by 0.25° (3° divided by 12 ports). For example, the ports 406 may be 24.25° apart. Of course a variety of dimensions and angles may be suitable depending upon the size and number of connectors, and the mechanics of the platen.

Figure 10A:
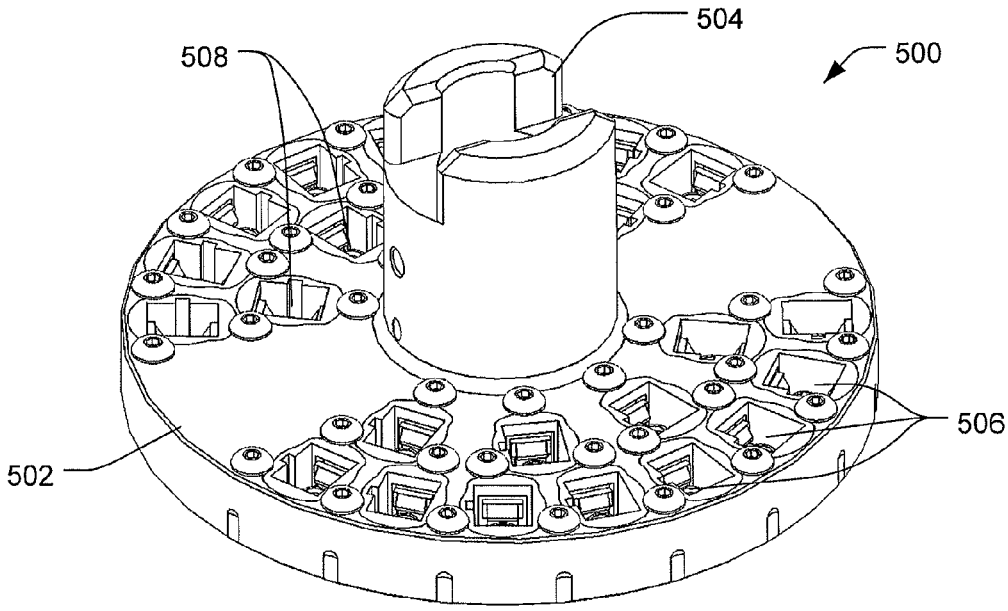
FIG. 10A is a perspective view of a polishing fixture according to some embodiments of the invention.
Figure 10B:
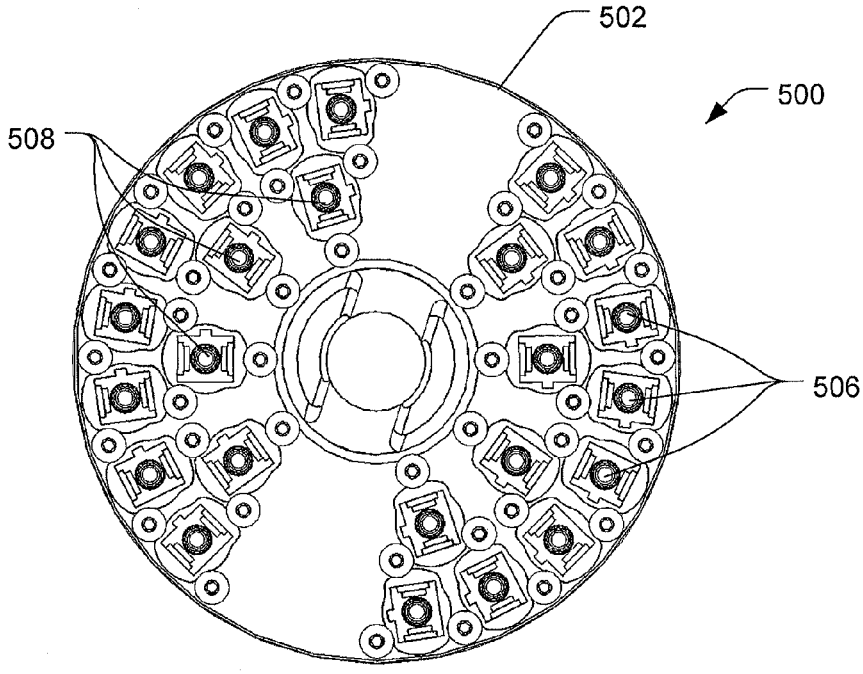
FIG. 10B is a top view of the polishing fixture of FIG. 10A.
Figure 10C:
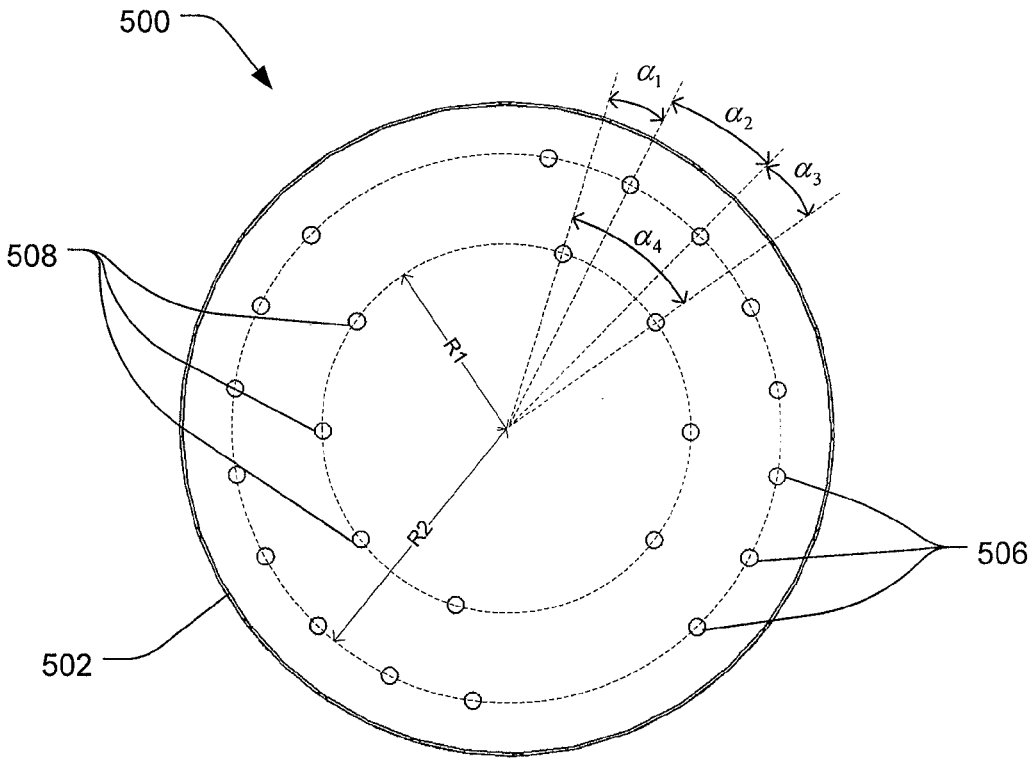
FIG. 10C is a bottom view of the polishing fixture of FIG. 10A.

Referring now to FIGS. 10A-10C, in some embodiments of the invention, a polishing fixture 500 is provided including a base 502, a mounting tube 504, an outer group (e.g., ring) of ports 506 and an inner group (e.g., ring) of ports 508. Similar to the embodiment shown in FIGS. 9A-9C, this embodiment has the inner ring of ports 508 approximately positioned at a substantially smaller average radius, $R_1$, than the outer ring of ports 506. For example, the inner ring of ports 508 may be positioned at approximately a radius of about 1.0 inch, while the outer ring of ports 506 may be positioned at approximately a radius of 1.5 inches. In another embodiment, the inner ring of ports 508 may be positioned at a radius of about 0.975 inches. Configurations such as these provide a greater capacity for a larger number of connectors while also utilizing a greater area of an abrasive film.

In addition, the ports 506, 508 may also have a variety of angular separations and radial distances, as described with respect to previous embodiments. For example, some or all of the ports 506, 508 may be located at unique radial distances from the center of the fixture base 502. In another embodiment, adjacent ports in the outer ring 506 and/or the inner ring 508 of ports may have an angular separation $\alpha_1$, $\alpha_2$, $\alpha_3$, $\alpha_4$, etc., based on the relative motion of the platen and fixture to produce distinct wear paths on the abrasive film for one or more ports. Of course a variety of dimensions and angles may be suitable depending upon the size and number of connectors, and the relative motion between the platen and the fixture.

In an additional embodiment, multiple wear paths may be provided by changing the alignment of the polishing fixture with the rotating platen. As described, in many cases, platens are configured to revolve around the center of the polishing fixture. In some embodiments of the invention, multiple wear paths are provided upon an abrasive surface by shifting the center of revolution from the center of the polishing fixture. For example, referring briefly to FIG. 1, in some embodiments the overarm assembly 20 and mounting pole 28 are shifted slightly sideways away from the center of revolution of the platen assembly 30. The shift is small enough to ensure that the ports on an attached fixture are always positioned above the abrasive, but large enough to provide an off-axis alignment. Thus, some or all of the ports on a fixture can be provided with a distinct wear path upon an abrasive film.

Figure 11:
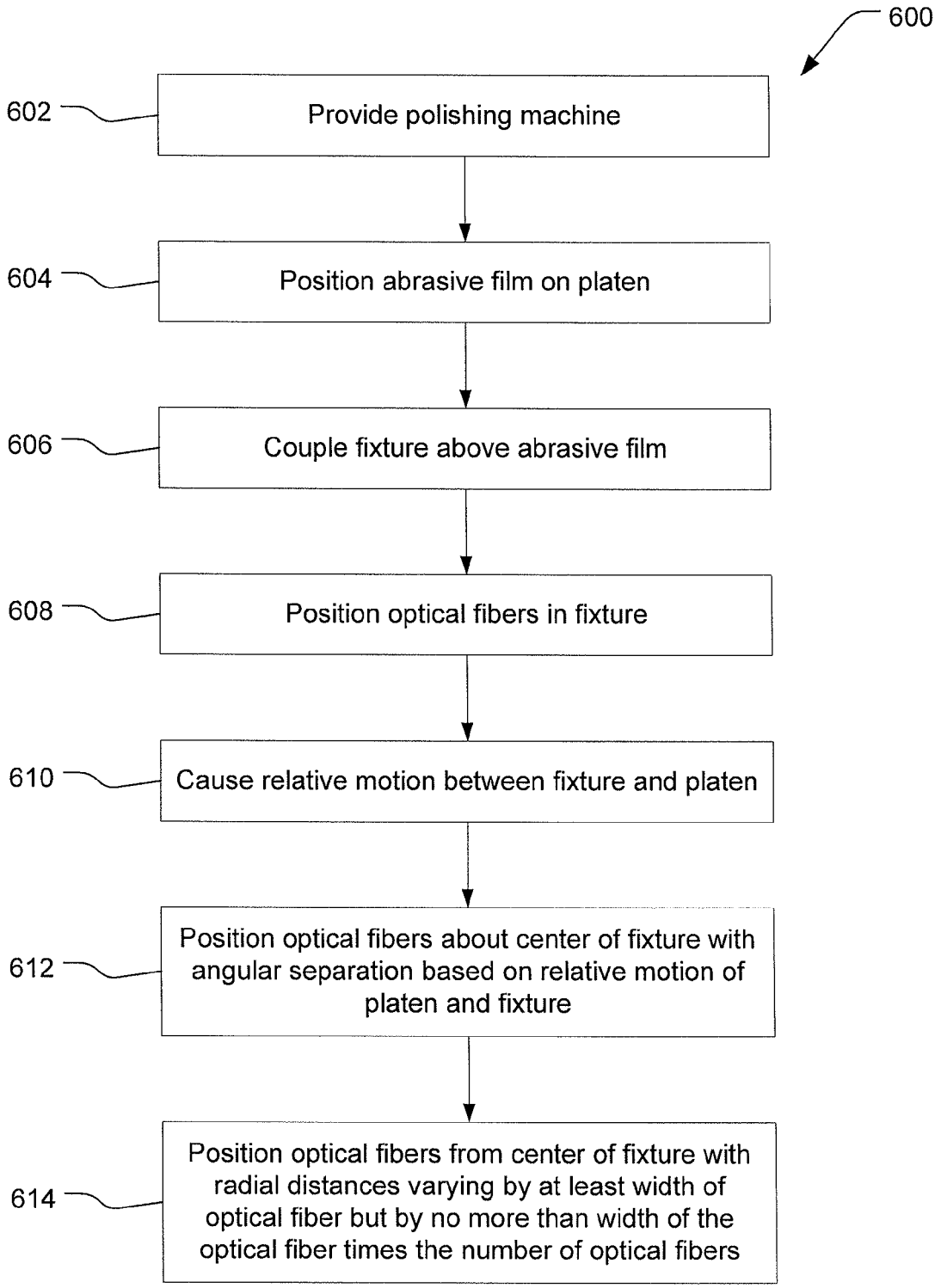
FIG. 11 is a flow diagram illustrating a method of polishing optical fibers according to some embodiments of the invention.

FIG. 11 is a flow diagram illustrating a method 600 of polishing optical fibers according to some embodiments of the invention. The method includes providing (602) an optical fiber polishing machine having a platen and positioning (604) an abrasive film on the platen of the polishing machine. An optical fiber polishing fixture is coupled (606) above the platen and the abrasive film. The method 600 further includes positioning (608) a plurality of optical fibers in the fixture and causing (610) a relative motion between the fixture and the platen. In some embodiments the method 600 further includes positioning (612) at least a first optical fiber and a second optical fiber about a center of the fixture with an angular separation with respect to the center of the fixture based on the relative motion of the platen and the fixture such that the first optical fiber and the second optical fiber follow distinct wear paths upon the abrasive film as the platen and the fixture undergo the relative motion.

In some embodiments the method 600 may further include positioning (614) at least the first optical fiber and the second optical fiber from the center of the fixture at respective radial distances varying by a least about a width of an optical fiber, but by no more than about the width of the optical fiber times the quantity of the plurality of optical fibers, thereby producing distinct wear paths upon the abrasive film for the first optical fiber and the second optical fiber as the platen and the fixture undergo the relative motion.

In the foregoing detailed description, the invention has been described with reference to specific embodiments. However, it may be appreciated that various modifications and changes can be made without departing from the scope of the invention. For example, relative movement between the polishing fixture and platen may be provided by moving a polishing fixture relative to a fixed platen and abrasive film. In addition, the configuration of ports on a polishing fixture may be varied to provide one or more distinct wear paths depending upon the particular relative movement of the abrasive film with respect to the ports. For example, for mechanical systems not involving an eccentric drive, a port configuration other than a circumferential configuration may be useful. Thus, some of the features of preferred embodiments described herein are not necessarily included in preferred embodiments of the invention which are intended for alternative configurations. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended laims.

What is claimed is:

1. An optical fiber polishing fixture for use with an optical fiber polishing machine, the fixture comprising:

a base having a bottom surface and a plurality of ports;

wherein the ports are positioned about a center of the base and extend through the bottom surface of the base;

wherein each port is configured to align an optical fiber above a platen of the optical fiber polishing machine for polishing an end of the optical fiber as the platen and the fixture undergo a relative motion, the relative motion comprising a rotational motion in which the platen rotates about an axis of the platen and a revolving motion in which the platen revolves a first amount of revolution about the center of the base for every rotation of the platen; and wherein an angular separation between at least a first port and a second port with respect to the center of the fixture base is a sum of a multiple of the first amount of revolution and the first amount of revolution divided by the quantity of the plurality of ports, such that the first port and the second port follow distinct wear paths upon an abrasive surface on the platen as the platen and the fixture undergo the relative motion.

2. The fixture of claim 1, wherein the angular separation is different from a multiple of the first amount of revolution.

3. The fixture of claim 1, wherein angular separations between adjacent ports of the plurality of ports with respect to the center of the fixture base are based on the relative motion of the platen and the fixture such that the plurality of ports follow distinct wear paths upon the abrasive surface on the platen as the platen and the fixture undergo the relative motion.

4. The fixture of claim 3, wherein the angular separations between adjacent ports are different from a multiple of the first amount of revolution of the platen.

5. The fixture of claim 3, wherein the angular separations between adjacent ports are the same.

6. The fixture of claim 1, wherein the plurality of ports are substantially positioned along one or more circular paths about the center of the base.

7. An optical fiber polishing fixture for use with an optical fiber polishing machine, the fixture comprising:

a base having a bottom surface and a plurality of ports;

wherein the ports are positioned about a center of the base and extend through the bottom surface of the base;

wherein each port is configured to align an optical fiber above a platen of the optical fiber polishing machine for polishing an end of the optical fiber as the platen and the fixture undergo a relative motion;

wherein an angular separation between at least a first port and a second port with respect to the center of the fixture base is based on the relative motion of the platen and the fixture such that the first port and the second port follow distinct wear paths upon an abrasive surface on the platen as the platen and the fixture undergo the relative motion; and wherein the first port and the second port are positioned from the center of the base at respective radial distances varying by at least about a width of an optical fiber, but by no more than about the width of the optical fiber times the quantity of the plurality of ports, wherein the varying radial distances of the first port and the second port produce distinct wear paths upon the abrasive surface on the platen for the first port and the second port as the platen and the fixture undergo the relative motion.

8. A system for polishing optical fibers, comprising:

the optical fiber polishing fixture of claim 1; and an optical fiber polishing machine having a platen configured to retain an abrasive film, a mounting mechanism coupled to the fixture, and a drive mechanism, the drive mechanism causing the fixture and the platen to undergo the relative motion.

9. An optical fiber polishing fixture for use with an optical fiber polishing machine, the fixture comprising:

a base having a bottom surface and a plurality of ports;

wherein the ports are positioned about a center of the base and extend through the bottom surface of the base;

wherein each port is configured to align an optical fiber above a platen of the optical fiber polishing machine for polishing an end of the optical fiber as the platen and the fixture undergo a relative motion;

wherein at least a first group of the plurality of ports are substantially positioned along a first circular path about the center of the base;

wherein a first port and a second port in the first group of ports are positioned from the center of the base at respective radial distances varying by at least about a width of an optical fiber, but by no more than about the width of the optical fiber times the quantity of ports in the first group; and wherein the varying radial distances of the first port and the second port produce distinct wear paths upon an abrasive surface on the platen for the first port and the second port as the platen and the fixture undergo the relative motion.

10. The fixture of claim 9, wherein the first group of ports are positioned from the center of the base at respective radial distances varying by at least about the width of an optical fiber, but by no more than about the width of the optical fiber times the quantity of ports in the first group, thereby producing distinct wear paths upon the abrasive surface on the platen for each port in the first group of ports as the platen and the fixture undergo the relative motion.

11. The fixture of claim 10, wherein the radial distance of each port in the first group of ports is different than the radial distances of other ports in the first group of ports.

12. The fixture of claim 9, wherein at least a second group of the plurality of ports are substantially positioned along a second circular path between the center of the base and the first circular path, wherein a third port and a fourth port in the second group of ports are positioned from the center of the base at radial distances varying by at least about the width of an optical fiber, but by no more than about the width of the optical fiber times the quantity of ports in the second group, wherein the varying radial distances of the third port and the fourth port produce distinct wear paths upon the abrasive surface on the platen for the third port and the fourth port as the platen and the fixture undergo the relative motion.

13. The fixture of claim 9, wherein an angular separation between at least the first port and the second port with respect to the center of the fixture base is based on the relative motion of the platen and the fixture such that the first port and the second port follow distinct wear paths upon the abrasive surface on the platen as the platen and the fixture undergo the relative motion.

14. A system for polishing optical fibers, comprising:

the optical fiber polishing fixture of claim 9; and an optical fiber polishing machine having a platen configured to retain an abrasive film, a mounting mechanism coupled to the fixture, and a drive mechanism, the drive mechanism causing the fixture and the platen to undergo the relative motion.

* * * * *